US009375857B2

(12) United States Patent
Evans

(10) Patent No.: US 9,375,857 B2
(45) **Date of Patent: *Jun. 28, 2016**

(54) CUTTING ANVIL AND METHOD

(71) Applicant: The Boeing Company, Chicago, IL (US)

(72) Inventor: Richard B. Evans, Maple Valley, WA (US)

(73) Assignee: THE BOEING COMPANY, Chicago, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/781,725

(22) Filed: Feb. 28, 2013

(65) Prior Publication Data

US 2013/0174708 A1 Jul. 11, 2013

Related U.S. Application Data

(62) Division of application No. 12/205,573, filed on Sep. 5, 2008, now Pat. No. 8,387,502, which is a division of application No. 10/829,269, filed on Apr. 22, 2004, now Pat. No. 8,495,943.

(51) Int. Cl.

| | |
|---|---|
| ***B26D 3/06*** | (2006.01) |
| ***B26D 7/08*** | (2006.01) |
| ***B26D 7/20*** | (2006.01) |
| *B26D 1/02* | (2006.01) |
| *B26D 1/04* | (2006.01) |

(52) U.S. Cl.

CPC *B26D 3/06* (2013.01); *B26D 7/086* (2013.01); *B26D 7/20* (2013.01); *B26D 1/025* (2013.01); *B26D 1/045* (2013.01); *Y10T 83/0304* (2015.04); *Y10T 83/4841* (2015.04); *Y10T 83/687* (2015.04); *Y10T 83/8745* (2015.04); *Y10T 83/9312* (2015.04); *Y10T 83/97* (2015.04)

(58) Field of Classification Search

CPC ..... B26D 7/086; B26D 7/20; B29C 65/08; Y10S 83/956; Y10S 83/917; Y10S 451/91

USPC ..... 83/941, 701, 956, 346, 347, 746, 561, 83/875

See application file for complete search history.

(56) References Cited

U.S. PATENT DOCUMENTS

| | | | | |
|---|---|---|---|---|
| 3,645,304 | A | 2/1972 | Thrasher | |
| 3,683,736 | A | 8/1972 | Loose | |
| 3,750,507 | A * | 8/1973 | Gerber et al. | 83/169 |
| 3,788,175 | A | 1/1974 | Davis | |

(Continued)

OTHER PUBLICATIONS

Office Action, dated Feb. 9, 2006, regarding U.S. Appl. No. 10/29,269, 14 pages.

(Continued)

*Primary Examiner* — Laura M Lee

(74) *Attorney, Agent, or Firm* — Yee & Associates, P.C.

(57) ABSTRACT

A cutting system includes a cutting assembly and an anvil. The cutting assembly includes an ultrasonic cutting tool having a stylus with a tip and an actuator to move the tip along a path. The path is oriented in a transverse manner relative to movement of a backed ply material. The anvil includes a rigid base for securing the anvil to the cutting assembly and a surface coinciding with the path. The system is configured to drive the tip into the surface and draw the tip along the path to generate a groove disposed upon the surface. The groove being in cooperative alignment with the tip.

19 Claims, 4 Drawing Sheets

(56) References Cited

U.S. PATENT DOCUMENTS

| | | | | |
|---|---|---|---|---|
| 3,918,337 | A | 11/1975 | Lindblad et al. | |
| 4,060,017 | A | 11/1977 | Backlund | |
| 4,077,290 | A | 3/1978 | Hreha | |
| 4,083,390 | A * | 4/1978 | Ingham | 144/136.9 |
| 4,133,711 | A | 1/1979 | August et al. | |
| 4,208,238 | A | 6/1980 | August et al. | |
| 4,373,412 | A | 2/1983 | Gerber et al. | |
| 4,438,698 | A | 3/1984 | Sullivan, Jr. et al. | |
| 4,867,023 | A | 9/1989 | Kozyrski et al. | |
| 4,867,834 | A | 9/1989 | Alenskis et al. | |
| 4,920,495 | A | 4/1990 | Pilkington | |
| 4,925,515 | A | 5/1990 | Yoshimura et al. | |
| 5,028,052 | A | 7/1991 | Miller | |
| 5,072,640 | A | 12/1991 | Greve et al. | |
| 5,265,508 | A | 11/1993 | Bell et al. | |
| 5,368,464 | A | 11/1994 | Stewart et al. | |
| 5,480,508 | A | 1/1996 | Manabe et al. | |
| 5,688,351 | A | 11/1997 | Thomas | |
| 5,944,924 | A | 8/1999 | Engle et al. | |
| 6,048,353 | A | 4/2000 | Freed et al. | |
| 6,152,003 | A | 11/2000 | Jung | |
| 6,308,391 | B1 * | 10/2001 | Blaimschein et al. | 29/412 |
| 6,637,490 | B1 | 10/2003 | Azulay | |
| 6,720,058 | B1 | 4/2004 | Weeks et al. | |
| 6,749,102 | B2 | 6/2004 | Yamano et al. | |
| 6,755,105 | B2 | 6/2004 | Downing | |
| 6,813,985 | B2 | 11/2004 | Gharst et al. | |
| 8,387,502 | B2 | 3/2013 | Evans | |
| 2002/0078814 | A1 * | 6/2002 | Kansteiner et al. | 83/875 |
| 2004/0079208 | A1 | 4/2004 | Carlson et al. | |
| 2005/0081692 | A1 | 4/2005 | Mosiewicz et al. | |
| 2005/0235795 | A1 | 10/2005 | Evans | |
| 2009/0000451 | A1 | 1/2009 | Evans | |

OTHER PUBLICATIONS

Final Office Action, dated Feb. 22, 2007, regarding U.S. Appl. No. 10/29,269, 13 pages.
Office Action, dated Jul. 26, 2007, regarding U.S. Appl. No. 10/29,269, 12 pages.
Final Office Action, dated Mar. 21, 2008, regarding U.S. Appl. No. 10/29,269, 10 pages.
Office Action, dated Dec. 5, 2008, regarding U.S. Appl. No. 10/29,269, 11 pages.
Final Office Action, dated Jun. 22, 2009, regarding U.S. Appl. No. 10/29,269, 12 pages.
Office Action, dated Oct. 16, 2009, regarding U.S. Appl. No. 10/29,269, 9 pages.
Final Office Action, dated Feb. 1, 2010, regarding U.S. Appl. No. 10/29,269, 11 pages.
Office Action, dated May 15, 2009, regarding U.S. Appl. No. 12/205,573, 15 pages.
Final Office Action, dated Oct. 15, 2009, regarding U.S. Appl. No. 12/205,573, 11 pages.
Office Action, dated Feb. 1, 2010 regarding U.S. Appl. No. 12/205,573, 11 pages.
Final Office Action, dated Jul. 16, 2010 regarding U.S. Appl. No. 12/205,573, 10 pages.
Office Action, dated Nov. 2, 2010 regarding U.S. Appl. No. 12/205,573, 9 pages.
Final Office Action, dated Apr. 13, 2011 regarding U.S. Appl. No. 12/205,573, 13 pages.
Office Action, dated Nov. 10, 2011 regarding U.S. Appl. No. 12/205,573, 11 pages.
Final Office Action, dated Jun. 22, 2012 regarding U.S. Appl. No. 12/205,573, 7 pages.
Notice of Allowance, dated Nov. 2, 2012, regarding U.S. Appl. No. 12/25,573, 9 pages.
Notice of Allowance, dated Mar. 27, 2013, regarding U.S. Appl. No. 10/829,269, 8 pages.

* cited by examiner

CUTTING ANVIL AND METHOD

CROSS REFERENCE TO RELATED APPLICATIONS

This application is a divisional of application Ser. No. 12/205,573 filed Sep. 5, 2008. application Ser. No. 12/205,573 is a divisional of application Ser. No. 10/829,269, filed on Apr. 22, 2004. The present application claims priority through each of these application.

TECHNICAL FIELD

The present disclosure generally relates to an anvil for supporting cuts in sheet and roll stock. More particularly, the present disclosure pertains to an improved anvil for supporting cuts in composite ply material and its method of use.

BACKGROUND

Composite structures are typically constructed from multiple layers or plies. These plies may include a variety of materials such as carbon fiber, various other fibers, metal foils, and the like. In addition, the plies may be pre-impregnated with a resin and are often dispensed from a roll or spool. In roll form, the ply material may be referred to as "tape" and typically includes a paper backing film. This backing film generally prevents pre-impregnated ply material (prepreg) from adhering to itself and aids in handling the ply as the ply is applied to the tool and the layup. In particular, at the beginning and end of each ply placement, the ply material is generally cut to match the profile of the layup while the backing film is left intact. In this manner, the intact backing film is utilized to guide the severed ply on to the layup. During the layup process, the backing film is removed prior to placement of any subsequent ply. To provide support for the material being cut and facilitate cutting to a proper depth, an anvil is typically utilized. The anvil may be situated on the opposite side of the tape from the cutting tool and lays along the cutting path or is controlled to move in unison with the cutting tool.

A disadvantage associated with conventional anvils is the relatively high precision required to install and prepare them for use. Minor deviations in height adjustment may result in incomplete cuts of the ply material or cutting of the backing film. In particular, cuts in the backing film, introduced during the ply cutting procedure, may serve as a starting point for a tear. As the backing film is removed, torn backing film may remain on the ply, may fowl the ply placement head, and/or may lead to breakage of the backing film.

Another disadvantage associated with conventional anvils is that essentially any contact between the cutting tool and the anvil while setting up the cutting assembly or during use may result in damage to the cutting tool and/or the anvil. Even apparently minor damage to the cutting tool may produce unsatisfactory cutting performance and thus, require cutting tool replacement or regrinding. Damage to the anvil typically manifests itself as score marks. These score marks may cause cutting problems resulting from an altered cutting surface and generally tend to increase the drag of the tape as the tape is fed through the tape laying head. Down time associated with replacement of the cutting tool and/or anvil wastes resources.

Accordingly, it is desirable to provide a anvil that is capable of overcoming the disadvantages described herein at least to some extent.

SUMMARY

The foregoing needs are met, to a great extent, by the present disclosure, wherein in some embodiments an anvil that facilitates cutting ply material is provided.

An embodiment of the present disclosure relates to a system for cutting a backed ply material with an ultrasonic blade. The system includes an ultrasonic cutting tool, and an anvil. The ultrasonic cutting tool includes a stylus. This stylus includes a tip. The anvil includes a first surface to support a backed ply material at a first height, a second surface to support the backed ply material at a second height, and a third surface in cooperative alignment with the tip. The third surface is disposed between the first surface and the second surface. The third surface provides support for the backing at a third height and the third height is relatively below the first height and the second height.

Another embodiment of the present disclosure relates to a cutting system including a cutting assembly and an anvil. The cutting assembly include an ultrasonic cutting tool having a stylus with a tip and an actuator to move the tip along a path. The path is oriented in a transverse manner relative to movement of a backed ply material. The anvil includes a rigid base for securing the anvil to the cutting assembly and a surface coinciding with the path. The system is configured to drive the tip into the surface and draw the tip along the path to generate a groove disposed upon the surface. The groove being in cooperative alignment with the tip.

There has thus been outlined, rather broadly, certain embodiments of the disclosure in order that the detailed description thereof herein may be better understood, and in order that the present contribution to the art may be better appreciated. There are, of course, additional embodiments of the disclosure that will be described below and which will form the subject matter of the claims appended hereto.

In this respect, before explaining at least one embodiment in detail, it is to be understood that the disclosure is not limited in its application to the details of construction and to the arrangements of the components set forth in the following description or illustrated in the drawings. The various embodiments are capable of embodiments in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present disclosure. It is important, therefore, that the claims be regarded as including such equivalent constructions insofar as they do not depart from the spirit and scope of the present disclosure.

DETAILED DESCRIPTION

The present disclosure provides, in some embodiments, a cutter assembly, an anvil for the cutter assembly, and a method of generating the anvil. In an embodiment provides for an anvil for cutting a backed ply material.

Figure 1:
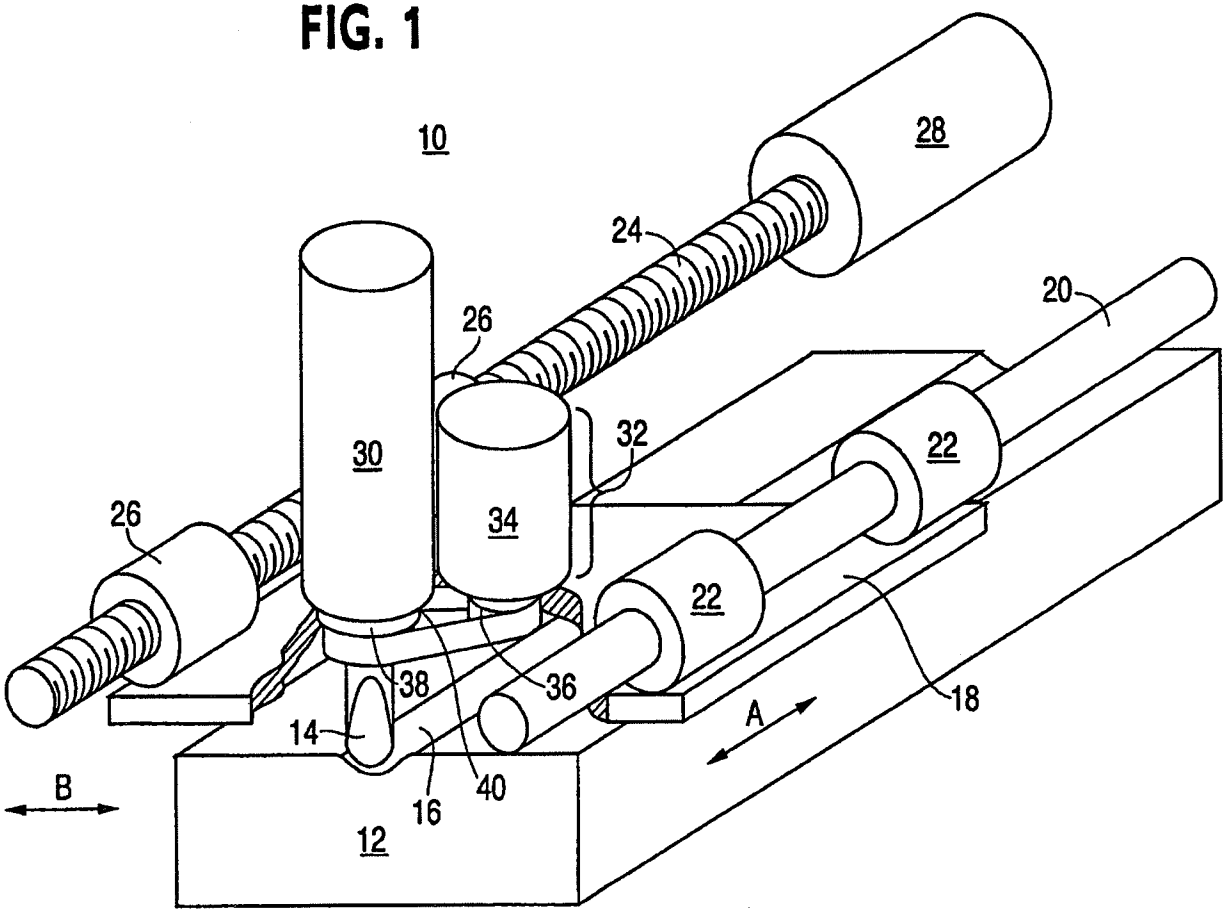
FIG. 1 is perspective view of a cutter assembly according to an embodiment of the disclosure.

Some embodiments will now be described with reference to the drawing figures, in which like reference numerals refer to like parts throughout. As shown in FIG. 1, a cutting assembly 10 includes an anvil 12 and a stylus 14. The anvil 12 and the stylus 14 are juxtaposed in co-operative alignment to facilitate cutting of ply material. That is, the anvil 12 provides support for the ply material and thereby facilitates the cutting action of the stylus 14. In various embodiments of the disclosure, the anvil 12 includes a groove 16 cooperatively aligned with the stylus 14. In a particular embodiment shown in FIG. 1, the groove 16 is coincidental with a path of the stylus 14. In this regard, the stylus 14 is mounted to a platform 18. Movement of this platform 18 may be controlled in any suitable manner. Examples of suitable movement control systems generally include guide and/or actuating devices such as rails, rack and pinions, linear drive belts, linear slides, X-Y tables, pneumatic rams, linear actuators, various armatures, and the like.

In a particular example shown in FIG. 1, the movement of the platform 18 is controlled by the action of a guide bar 20, pillow blocks 22, lead screw 24, and pillow blocks 26. The pillow blocks 22 slidably engage the guide bar 20. The pillow blocks 26 are tapped to mate with the threads of the lead screw 24. In addition, a stepper motor 28 is controlled to rotate the lead screw 24 and thereby modulate the position of the stylus 14 along the groove 16. In this manner, the stylus 14 is controlled to move as indicated by direction A.

Depending upon the material to be cut and/or the particular application, the cutting assembly 10 may further include and ultrasonic transducer 30 and stylus orientation assembly 32. The ultrasonic transducer 30 generates vibrational energy that is transmitted through the stylus 14 and thereby facilitate cutting of various materials. The stylus orientation assembly 32 includes a stepper motor 34, pulleys 36 and 38, and belt 40. To modulate the orientation of the stylus 14, the stepper motor 32 is controlled to rotate the pulley 36. This rotation is transferred via the belt 40 to the pulley 38 which, in turn, causes the rotation of the stylus 14.

In operation, a sheet of ply material or backed ply material is fed between the platform 18 and the anvil 12 and generally controlled to move as indicated by direction B. By controlling the movement of the ply material in conjunction with the movement of the various components of the cutting assembly 10, the cutting assembly 10 is controllable to generate slitting cuts, butt cuts, tapers, curves, and the like.

Figure 2:
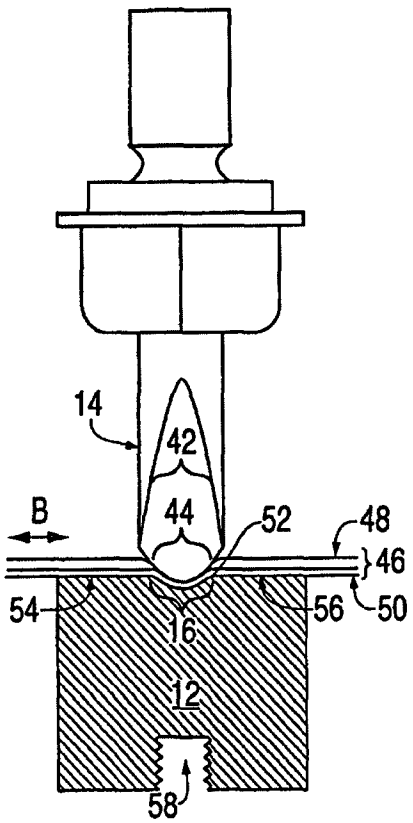
FIG. 2 is a side view of an anvil according to an embodiment.

FIG. 2 is a cross sectional view of the anvil 12 according to an embodiment of the disclosure. In the embodiment shown in FIG. 2, the anvil 12 is essentially a single piece of suitable material. Materials suitable for use in the anvil 12 include relatively stable, strong and/or wear resistant materials such as, for example: metals and/or metal alloys; laminates; plastics; phenolic resins; and the like. In a particular example, the anvil 12 may be formed from steel.

Another material for use in the anvil 12 includes any suitable dimensionally stable, rigid and/or wear resistant material. Particular examples of such suitable materials include Micarta® and other such high pressure laminates produced by Industrial Laminates/Norplex, Inc. of Postville, Iowa 52162, USA. An advantage of the use of high pressure laminates is that contact between the stylus 14 and a high pressure laminate tends to have fewer negative effects than contact between the stylus 14 and a relatively hard metal. In addition, in an embodiment of the disclosure, it is preferable that the material for use in the anvil 12 be readily carved or scraped as well as dimensionally stable, rigid and/or wear resistant. In this embodiment and as described herein, the stylus 12 may be utilized to generate the groove 16 in the insert 60. In this manner, the groove 16 may essentially correspond to a profile of the tip 44.

As shown in FIG. 2, the anvil 12 includes the groove 16. As stated herein, the groove 16 is cooperatively aligned with the stylus 14. In particular, the groove 16 is aligned with an edge 42 of the stylus 14 and, more particularly, the groove 16 is aligned with a tip 44 of the stylus 14.

According to an embodiment of the disclosure, the cutting assembly 10 is operable to cut a backed ply material 46. In this regard, the backed ply material 46 includes a ply 48 and a backing 50. In various embodiments of the disclosure, the ply material 46 may include any suitable sheet stock. Examples of suitable sheet stocks include: woven fiber fabric; oriented strand tape; metal foil such as aluminum alloy and titanium foil; composite materials such as titanium graphite metal-fiber laminates; and the like. In a particular embodiment, the ply material 48 is a graphite fiber tape pre-impregnated with an epoxy or toughened epoxy resin (pre-preg). In another particular embodiment, the ply material 48 is a toughened epoxy resin coated titanium foil. In general, the backing 50 lends support to the ply material 48 and aids in handling the ply material 48. In this regard, during layup operations, the backing 50 is typically removed. Examples of suitable backing materials generally include conventional backing materials as well as resilient, compliant, or materials otherwise polymeric in nature. For the purpose of this disclosure, the terms, "polymeric" and "polymer" and variations thereof are defined as a chemical compound or mixture of compounds formed by a chemical reaction in which two or more molecules combine to form a larger molecule that includes repeating structural units. In addition, other examples of suitable backing material and backed ply material may be found in co-pending U.S. patent application Ser. No. not yet assigned, entitled, "Backing Film and Method for Ply Materials", having inventor Richard B. Evans, and having a filing date of Apr. 22, 2004, the disclosure of which is hereby incorporated by reference in its entirety.

Figure 3:
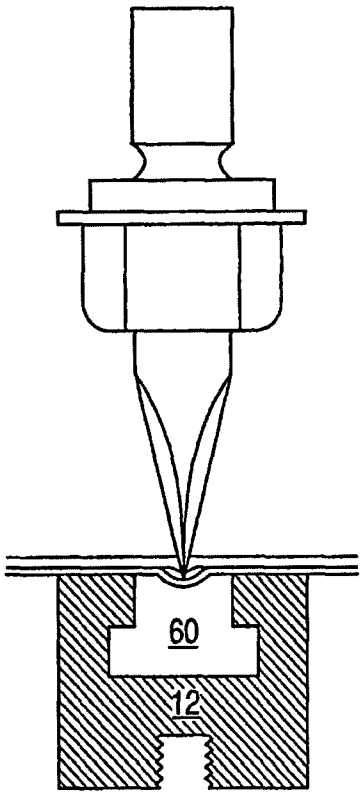
FIG. 3 is a side view of an anvil according to another embodiment.

In operation, the backed ply material 46 is moved, relative to the stylus 14. Oriented as indicated by the direction B, the cutting assembly 10 is configured to produce a slitting operation. As shown in FIG. 3, the stylus 14 is oriented to produce a butt cut. That is, the stylus 14 is drawn across the backed ply material 46 while the backed ply material 46 remains essentially stationary. In addition, taper cuts may be produced by disposing the stylus 14 at a desired orientation and moving both the stylus 14 and the backed ply material 46 in a substantially simultaneous and cooperative manner. During the various operations, the ply material 48 is cut while the backing 50 passes between the tip 44 and the groove 16. In this regard, according to an embodiment of the disclosure, the stylus 14 and the anvil 12 do not touch during ply cutting operations. That is, a gap 52 is substantially maintained between the edge 44 and the groove 16. This gap 52 is generally set prior to ply cutting operations. It is an advantage of some embodiments of the disclosure that the cutting assembly 10 properly cuts the ply 48 without cutting the backing 50 through a greater range of gap settings than conventional cutting assemblies. As such, setting the gap 52 is relatively easier and faster than setting the gap in conventional cutting assemblies.

Optionally, the anvil 12 includes a pair of transition surfaces 54 and 56 and a tapped bore 58. The transition surfaces 54 and 56, if present, facilitate alignment of the groove 16 with any suitable surface and/or tape guide. That is, according to an embodiment of the disclosure, the cutting assembly 10 is installed within a tape chute of a tape laying head. The tape chute includes surfaces and/or devices that guide the tape through the tape chute. When the anvil 12 is installed in the tape laying head, the groove 16 is typically aligned with the surfaces and/or devices that guide the tape through the tape chute. In some embodiments, the transition surfaces 54 and 56 facilitate this alignment. However, in other embodiments, the groove 16 aligned without the surfaces and/or devices that guide the tape through the tape chute.

The tapped bore 58, if present, facilitates securing the anvil 12 to the cutting assembly 10. For example, a threaded bolt configured to engage the tapped bore 58, may be utilized to secure the anvil 12 to a case or frame member of the cutting assembly 10 and/or other such structures of a tape laying head. However, the anvil 12 need not be secured in this manner, but rather, the anvil 12 may be secured relative to the stylus 14 via any suitable fastening device.

FIG. 3 is a side view of the anvil 12 according to another embodiment of the disclosure. The embodiment illustrated in FIG. 3 is similar to the embodiment illustrated in FIG. 2. Therefore, in the interest of brevity, those elements described in FIG. 2 will not be described again with reference to FIG. 3. As shown in FIG. 3, the anvil 12 includes an insert 60. The insert 60 is secured to the anvil 12 in any suitable manner. For example, according to an embodiment of the disclosure, the insert 60 is machined to mate with a "T" slot machined into the anvil 12. In this manner, the insert 60 may be removably secured without the aid of an adhesive. In another example, the insert 60 may be affixed to the anvil 12 with an adhesive or mechanical fastener. Material for use as the insert 60 include any suitable materials having relatively good wear properties and a relatively low coefficient of friction. Examples of suitable materials generally include plastics, resins, and the like. Specific examples of suitable materials include one or more of: ultra high molecular weight (UHMW) polyethylene polymers; Delrin®; nylon, acetal; and the like.

Figure 4:
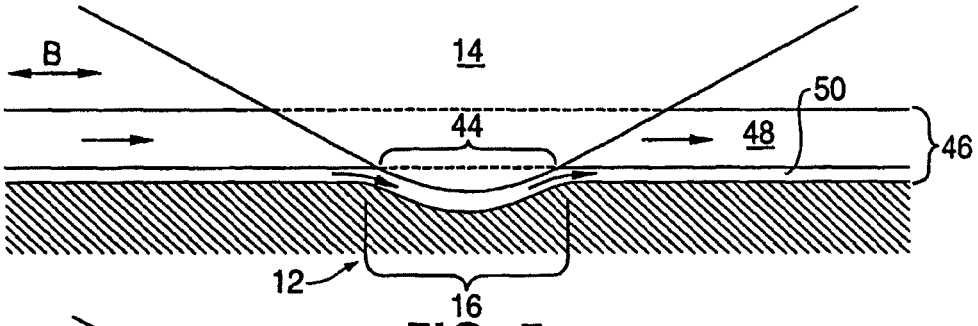
FIG. 4 is a side view of an interface between an anvil and a stylus in a slitting orientation according to an embodiment illustrated in FIG. 2.

FIG. 4 is a side view of an interface between the anvil 12 and the stylus 14 in a slitting orientation according to an embodiment of the disclosure illustrated in FIG. 2. As shown in FIG. 4, the path taken by the ply 48 and the backing 50 diverge slightly at the interface between the groove 16 and the tip 44. In this regard, in a preferred embodiment, the backing 50 is relatively more flexible than the ply 48. In a particular example where the ply 48 is a relatively rigid metal film such as toughened epoxy coated titanium foil, the backing 50 is relatively more flexible than the ply 48.

Figure 5:
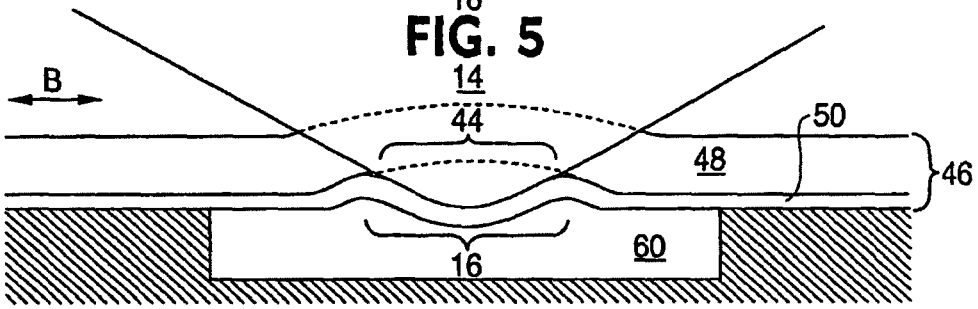
FIG. 5 is a side view of an interface between an anvil and a stylus in a slitting orientation according to yet another embodiment.

FIG. 5 is a side view of an interface between the anvil 12 and the stylus 14 in a slitting orientation according to yet another embodiment of the disclosure. As shown in FIG. 5, the insert 60 is readily deformable or compliant. That is, force exerted by the tip 44 upon the insert 60 generates the groove 16. In particular, the force exerted by the tip 44 may be translated via the backing 50 upon the insert 60. Additionally, the insert 60 of this embodiment is a "bond layer" of compliant material. For example, any suitably compliant material may be glued or otherwise affixed to the anvil 12. In this manner, a relatively flexible and resilient material may be affixed to a relatively rigid base. A particular example of a suitably compliant material includes a Vyon® membrane manufactured by Porvair Technologies of the United Kingdom.

Figure 6:
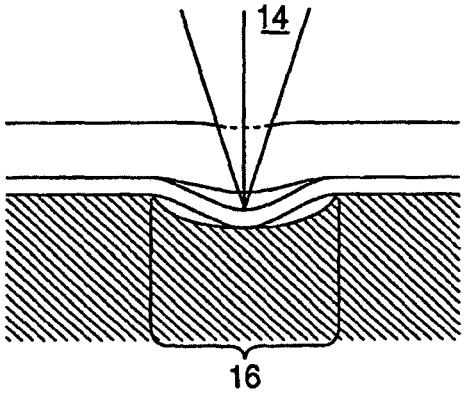
FIG. 6 is a side view of an interface between an anvil and a stylus in a butt cutting orientation according to an embodiment illustrated in FIG. 2.
Figure 7:
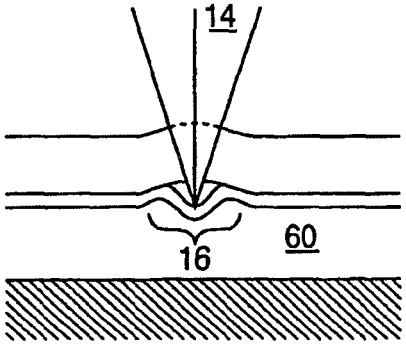
FIG. 7 is a side view of an interface between an anvil and a stylus in a butt cutting orientation according to an embodiment illustrated in FIG. 5.

According to an embodiment of the disclosure, by utilizing a compliant material in the insert 60, the groove 16 varies in response to modulations of the stylus 14 and/or the backed ply material 46. That is, when the stylus 14 is in a slitting orientation, the groove 16 is shaped generally as shown in FIG. 5, for example. In contrast, when the stylus 14 is in a butt cutting orientation, the groove 16 is shaped generally as shown in FIG. 7, for example. In this manner, the shape of the groove 16 is modulated in response to the stylus 14. However, in other embodiments of the disclosure, the groove 16 need not conform to the stylus 14. In this regard, FIG. 6 is a side view of an interface between the anvil 12 and the stylus 14 in a butt cutting orientation according to an embodiment of the disclosure illustrated in FIG. 2. As shown in FIG. 6, the groove 16 does not conform to the stylus 14.

Figure 8:
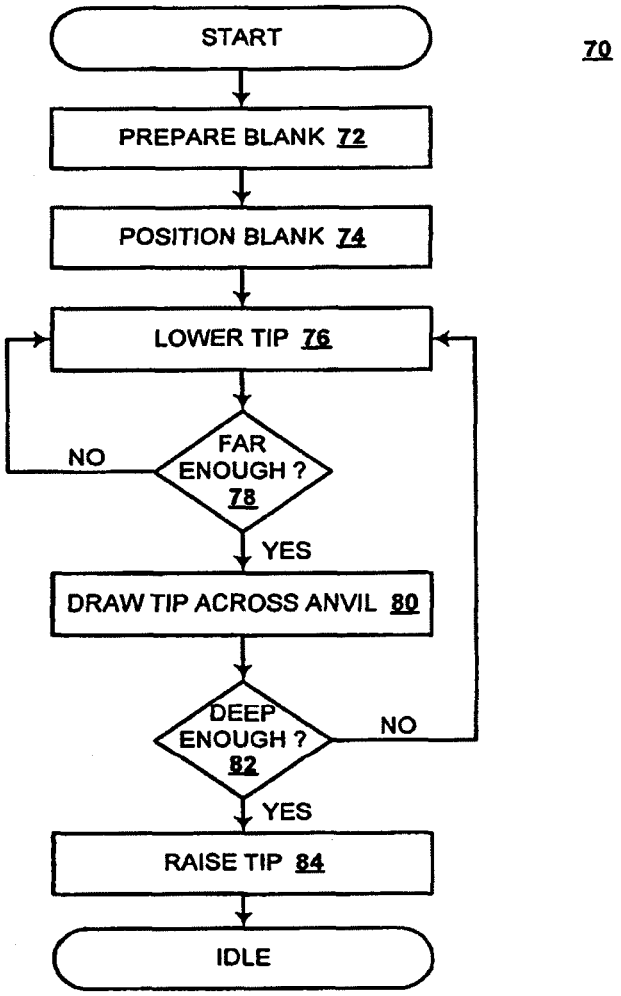
FIG. 8 is a flow diagram for a method of generating an anvil according to an embodiment.

FIG. 8 is a flow diagram for a method 70 of generating the anvil 12 according to an embodiment of the disclosure. In this embodiment, the cutting assembly 10 is utilized to generate the anvil 12. Prior to initiation of the method 70, a variety of preparative operations may be performed. For example, the cutting assembly 10 may be powered, materials and various components may be gathered, the stylus 14 may be oriented in a slitting configuration, and the like.

At step 72 a "blank" for the anvil 12 is prepared. In this regard, a, "blank" is essentially an anvil similar to the anvil 12 illustrated in FIG. 2 that substantially lacks the groove 16 is prepared for installation into the cutting assembly 10. This blank preferably includes a material that may be cut, scraped, and/or otherwise carved by the tip 44 without causing appreciable damage to the tip 44. Depending upon the particular configuration of the cutting assembly, an addition preparation for the blank may include milling and tapping the bore 58, milling and/or finishing the transition surfaces 54 and 56, and the like.

At step 74 the blank is secured to the cutting assembly 10. For example, one or more bolts may be utilized to fasten the blank to the cutting assembly 10. In addition, the position of the blank may be modulated by various leveling devices such that the transition surfaces are properly positioned.

At step 76 the tip 44 is lowered towards the blank. The method of lowering the tip 44 towards the blank is dependent upon the particular configuration of the cutting assembly 10. In this regard, the disclosure is not limited by the method of lowering the tip, nor is the term, "lowering" to be construed as limiting, but rather, any suitable manner of controlling the tip 44 and the blank to be drawn towards one another are within the purview of the disclosure.

At step 78 it is determined whether the tip 44 has been lowered sufficiently. In general, the tip 44 is to drive into the blank to a predetermined depth. This predetermined depth is based on a variety of factors such as, for example: hardness of the blank, friability of the blank, hardness of the tip 44, durability of an edge of the tip 44, power of the various drive mechanisms of the cutting assembly 10, and the like. Generally, the predetermined depth is such that, when the tip 44 is draw across the blank at step 80, a relatively smooth groove is generated. As such, the predetermined depth is dependent generally upon the material characteristics of the blank and the tip 44 as well as the angle the tip 44 meets the blank and the speed at which the tip 44 is drawn across the blank. In a particular embodiment, the tip 44 is driven about 1 to 3 thousandths of an inch into the blank. If it is determined that the tip 44 has not been lowered to the predetermined depth, the tip 44 is lowered further at step 76. If it is determined that the tip 44 has been lowered to the predetermined depth, the tip 44 is drawn across the blank at step 80.

At step 80 the tip 44 is drawn across the blank. For example, the tip 44 is controlled to move relative to the blank as indicated by direction A as shown in FIG. 1. In this manner, material from the blank is scraped or otherwise removed from the surface of the blank to generate the groove 16.

At step 82 it is determined whether the groove 16 is a predetermined depth. The predetermined depth of the groove 16 is dependent upon a variety of factors such as, for example: the material of the backing 50, the thickness of the backing 50, the configuration of the tip 44, the material characteristics of the ply 48, and the like. In general, the depth of the groove 16 is related to the thickness and material characteristics of the backed ply material 46. In an embodiment of the disclosure, the backing 50 is a relatively flexible, resilient material about 4 thousandths of an inch thick. In this embodiment, the predetermined depth of the groove 16 is about 3 thousandths of an inch deep. If it is determined that the groove 16 is not the predetermined depth, the tip 44 is lowered further at step 76. If it is determined that the groove 16 is the predetermined depth, the tip 44 is raised at step 84.

At step 84 the tip 44 is raised in preparation to perform ply cutting operations. It is an advantage of some embodiments of the present disclosure that setting the height of the tip 44 relative to the anvil 12 requires relatively less precision than in cutter assemblies employing conventional anvils. As such setup time is correspondingly reduced. Following this tip raising procedure, the cutting assembly idles or is shut down until ply cutting or other such operations are performed.

In addition, other embodiments of the disclosure include methods of generating the anvil 12 and/or the groove 16 that differ from that of the method 70. In particular, the groove 16 may be cast or milled into various metals. For example, a computer numerically controlled (CNC) milling machine may be instructed to mill the groove 16 into the anvil 12.

The many features and advantages of the various embodiments are apparent from the detailed specification, and thus, it is intended by the appended claims to cover all such features and advantages of the disclosure which fall within the true spirit and scope of the various embodiments. Further, since numerous modifications and variations will readily occur to those skilled in the art, it is not desired to limit the disclosure to the exact construction and operation illustrated and described, and accordingly, all suitable modifications and equivalents may be resorted to, falling within the scope of the various embodiments.

What is claimed is:

1. A system comprising:

a backed ply material comprising at least one ply and a backed ply, wherein the backed ply is relatively more flexible than the at least one ply;

a cutting assembly comprising an ultrasonic cutting tool including a stylus having an edge with a tip, the stylus being rotatable between a first orientation and a second orientation, and an actuator to move the stylus along a path, the path being oriented in a transverse manner relative to movement of the backed ply material; and an anvil comprising a rigid base securing the anvil to the cutting assembly, and a deformable insert secured to the base along the path, the insert having groove formed into a surface of the insert along the path, and wherein the groove has a cross-sectional shape corresponding to a cross-sectional shape of the edge, and wherein the groove is in cooperative alignment with the tip; wherein the cutting assembly is configured:

while the stylus is in the first orientation, to drive the tip into the surface of the insert and scrape the edge along the path to generate the groove in the surface; and while the stylus is in the second orientation, to cut the at least one ply without cutting the backed ply by deflecting the backed ply into a gap maintained between the tip and the groove.

2. The system according to claim 1, wherein the insert is disposed in the base.

3. The system according to claim 2, wherein the insert comprises a polymeric material.

4. The system according to claim 3, wherein the insert comprises at least one of an ultra high molecular weight polymer and nylon.

5. The system according to claim 1, wherein the anvil comprises a dimensionally stable, rigid, and wear resistant material.

6. The system according to claim 5, wherein the anvil comprises a metal.

7. The system according to claim 5, wherein the anvil comprises a high pressure laminate.

8. The system according to claim 5, wherein the anvil comprises at least one of a polymeric material and a resin.

9. The system according to claim 1, further comprising a first height of the surface and a second height of the surface, wherein the first height of the surface and the second height of the surface are disposed adjacent to and on opposite sides of the groove, and wherein the first height of the surface and the second height of the surface are essentially the same.

10. A ply cutting system comprising:

a backed ply material comprising at least one ply and a backed ply, wherein the backed ply is relatively more flexible than the at least one ply;

a cutting assembly comprising an ultrasonic cutting tool including a stylus having an edge with a tip, the stylus being rotatable between a first orientation and a second orientation, and an actuator to move the stylus along a path, the path being oriented in a transverse manner relative to movement of the backed ply material; and an anvil blank secured to the cutting assembly;

wherein the ply cutting system is configured to generate a groove in a surface of the anvil blank coinciding with the path prior to ply cutting operations by driving the tip into the anvil blank to a predetermined depth while the stylus is in the first orientation, and scraping the edge across the anvil blank along the path, wherein the groove has a cross-section shape corresponding to a cross-sectional shape of the edge; and to cut the at least one ply without cutting the backed ply by deflecting the backed ply into a gap maintained between the tip and the groove while the stylus is in the second orientation.

11. The ply cutting system of claim 10, wherein the anvil blank includes a material that does not cause damage to the tip when the anvil blank undergoes at least one of a cutting, a scraping, and a carving by the tip.

12. The system according to claim 10, wherein the anvil blank is disposed in the base.

13. The system according to claim 12, wherein the anvil blank comprises a polymeric material.

14. The system according to claim 13, wherein the anvil blank comprises at least one of an ultra high molecular weight polymer and nylon.

15. The system according to claim 10, wherein the anvil comprises a dimensionally stable, rigid, and wear resistant material.

16. The system according to claim 15, wherein the anvil comprises a metal.

17. The system according to claim 15, wherein the anvil comprises a high pressure laminate.

18. The system according to claim 15, wherein the anvil comprises at least one of a polymeric material and a resin.

19. The system according to claim 10, further comprising a first height of the surface and a second height of the surface, wherein the first height of the surface and the second height of the surface are disposed adjacent to and on opposite sides of the groove, and wherein the first height of the surface and the second height of the surface are essentially the same.

* * * * *